US006591452B2

(12) United States Patent
Jacquin

(10) Patent No.: US 6,591,452 B2
(45) Date of Patent: Jul. 15, 2003

(54) MOTOR VEHICLE DOOR, PARTICULARLY REAR DOOR, HINGE

(75) Inventor: Dominique Jacquin, Villebon sur Yvette (FR)

(73) Assignee: Oxford Automotive Mecanismes et Decoupage Fin, Les Ulis (FR)

( * ) Notice: Subject to any disclaimer, the term of this patent is extended or adjusted under 35 U.S.C. 154(b) by 0 days.

(21) Appl. No.: 09/771,587

(22) Filed: Jan. 30, 2001

(65) Prior Publication Data

US 2002/0059692 A1 May 23, 2002

(Under 37 CFR 1.47)

(51) Int. Cl.[7] ..... E05D 11/10; E05D 3/06

(52) U.S. Cl. ..... 16/332; 16/334; 16/366; 16/86 C; 296/146.12

(58) Field of Search ..... 16/332, 334, 86 C, 16/366; 296/146.11, 146.12

(56) References Cited

U.S. PATENT DOCUMENTS 2,039,130 A * 4/1936 Van Note
2,870,477 A 1/1959 Anthony et al.
2,873,470 A * 2/1959 De Dona
2,990,569 A * 7/1961 Pollak
4,446,596 A * 5/1984 Arlauskas ..... 16/333
4,672,715 A * 6/1987 Beckwith ..... 16/334
4,833,755 A * 5/1989 Bonin ..... 16/334
5,291,634 A * 3/1994 Zanetti ..... 16/333
5,570,498 A * 11/1996 Hipkiss et al. ..... 16/258
5,632,065 A * 5/1997 Sildake et al. ..... 16/335
5,685,046 A * 11/1997 Neag et al. ..... 16/336
5,926,917 A * 7/1999 Gantz ..... 16/334
6,038,738 A * 3/2000 Neag et al. ..... 16/324
6,105,208 A * 8/2000 Westerdale et al. ..... 16/334

* cited by examiner

*Primary Examiner*—Anthony Knight
*Assistant Examiner*—Alison K. Pickard
(74) *Attorney, Agent, or Firm*—Young & Thompson

(57) ABSTRACT

A hinge for a motor vehicle rear door (2) includes a fixed knuckle (20) mounted on the body (1) of the vehicle, a moving knuckle (30) mounted on the rear door (2), the door being movable between a closed position and an open position resting against the side of the body (1), and an intermediate knuckle (40) connected to each of the knuckles (20; 30) by a hinge pin (11; 15). The hinge also includes a device (60) for holding the rear door (2) in a wide-open position.

3 Claims, 8 Drawing Sheets

MOTOR VEHICLE DOOR, PARTICULARLY REAR DOOR, HINGE

BACKGROUND OF THE INVENTION

The present invention relates to a motor vehicle door hinge and particularly to a rear door hinge.

Certain motor vehicles, such as utility vehicles of the small van type, for example, are equipped with rear doors that can be moved between a closed position and an open position resting against the side of the body of the vehicle so as to completely uncover the loading platform and not protrude significantly from the width of this vehicle during the loading and unloading operations.

In order to allow the door to pivot between the two extreme positions, this door is equipped with a hinge which comprises a fixed knuckle mounted on the body of the vehicle, a moving knuckle mounted on the door, and an intermediate knuckle connected to each of the said knuckles via a hinge pin so as to allow the said door to pivot through about 250°.

The hinge comprises a blocking member cooperating with each of the pins to lock them in terms of rotation alternately and allow the successive pivoting of the moving knuckle about its pin through an angle of between 0 and 180°, then the pivoting of the assembly consisting of the intermediate knuckle and the moving knuckle about the pin of the fixed knuckle through an angle of between about 180 and 250°.

In the hinges hitherto used, the blocking member has been formed by a piece held on the intermediate knuckle by means of two screw-fastening elements which each pass through this piece via an oblong hole.

When the door is opened, the blocking member slides and successfully blocks the two pins by coming into contact with a flat formed on each of these pins so as, first of all, to allow the moving knuckle -to pivot by itself and then allow the assembly formed by the moving knuckle and the intermediate knuckle to pivot.

When the door is closed, the blocking member first of all blocks the pin of the moving knuckle so as to allow the assembly formed by the moving knuckle and the intermediate knuckle to pivot about the pin of the fixed knuckle and then blocks the pin of the fixed knuckle so as to allow only the moving knuckle to pivot about its pin.

Hitherto, rear doors have been equipped, in addition to hinges, with a stop system so as to hold them in the open position.

This independent stop system therefore leads to assembly operations which are in addition to those required for fitting the hinges and to an increase in the number of parts and thus in the cost.

The object of the invention is to avoid these drawbacks.

SUMMARY OF THE INVENTION

To this end, the subject of the invention is a motor vehicle rear door hinge of the type comprising:

a fixed knuckle mounted on the body of the vehicle, a moving knuckle mounted on the rear door, which door is movable between a closed position and an open position resting against the side of the body, an intermediate knuckle connected to each of the said knuckles by a hinge pin, characterized in that this hinge comprises means for holding the rear door in a wide-open position.

According to other features of the invention:

the holding means are formed by a cam, one end of which is mounted articulated on the intermediate knuckle and the other end of which, on one of its lateral edges, has a notch cooperating, when the rear door is in the wide-open position, with a stop member supported by the fixed knuckle, the lateral edge of the cam bearing the notch is held against the stop member by a pressing element cooperating with the opposite lateral edge of the said cam to the one bearing the said notch, the stop member is formed by a fixed roller mounted so that it is free to rotate on a pin supported by the fixed knuckle, the pressing element is formed by a moving roller mounted so that it is free to rotate on a support borne by the fixed knuckle, the said support being mounted so that it can pivot on a leg of the fixed knuckle and the said moving roller being held against the lateral edge of the cam by a spring acting on the said support, the lateral edge of the cam in contact with the moving roller comprises a catch for holding the intermediate knuckle while the moving knuckle is pivoting about its pin.

BRIEF DESCRIPTION OF THE DRAWINGS

The features and advantages of the invention will become apparent in the course of the description which will follow, which is given by way of example and made with reference to the appended drawings in which.

DESCRIPTION OF THE PREFERRED EMBODIMENTS

The hinge depicted in the figures and denoted overall by the reference 10 is intended to be mounted between a body 1 of a motor vehicle and a rear door 2 that can be moved between a closed position and an open position in which this rear door 2 rests against the side of the said body 1.

Figure 1:
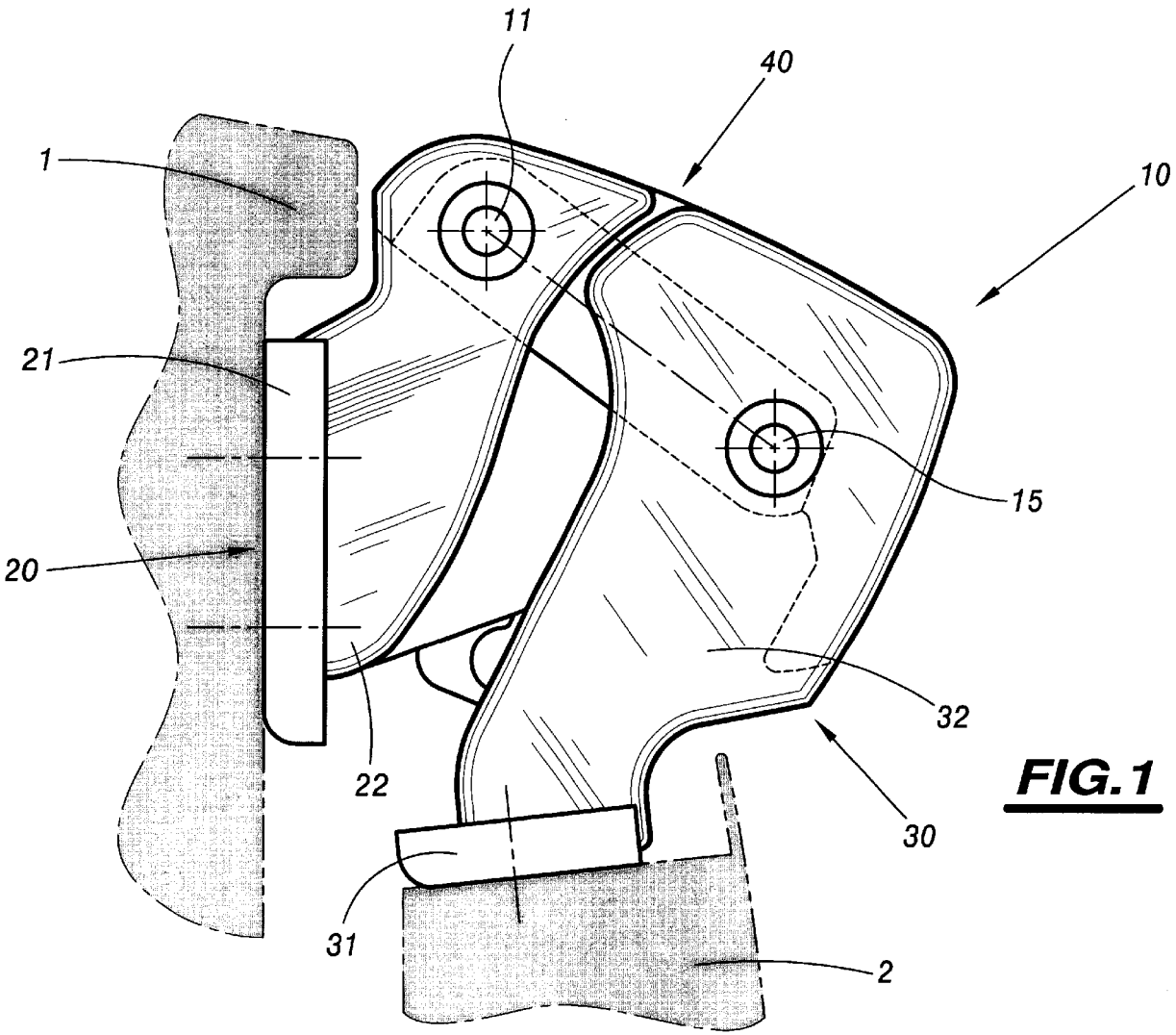
FIG. 1 is a schematic view from above of a motor vehicle rear door hinge according to the invention.
Figure 2:
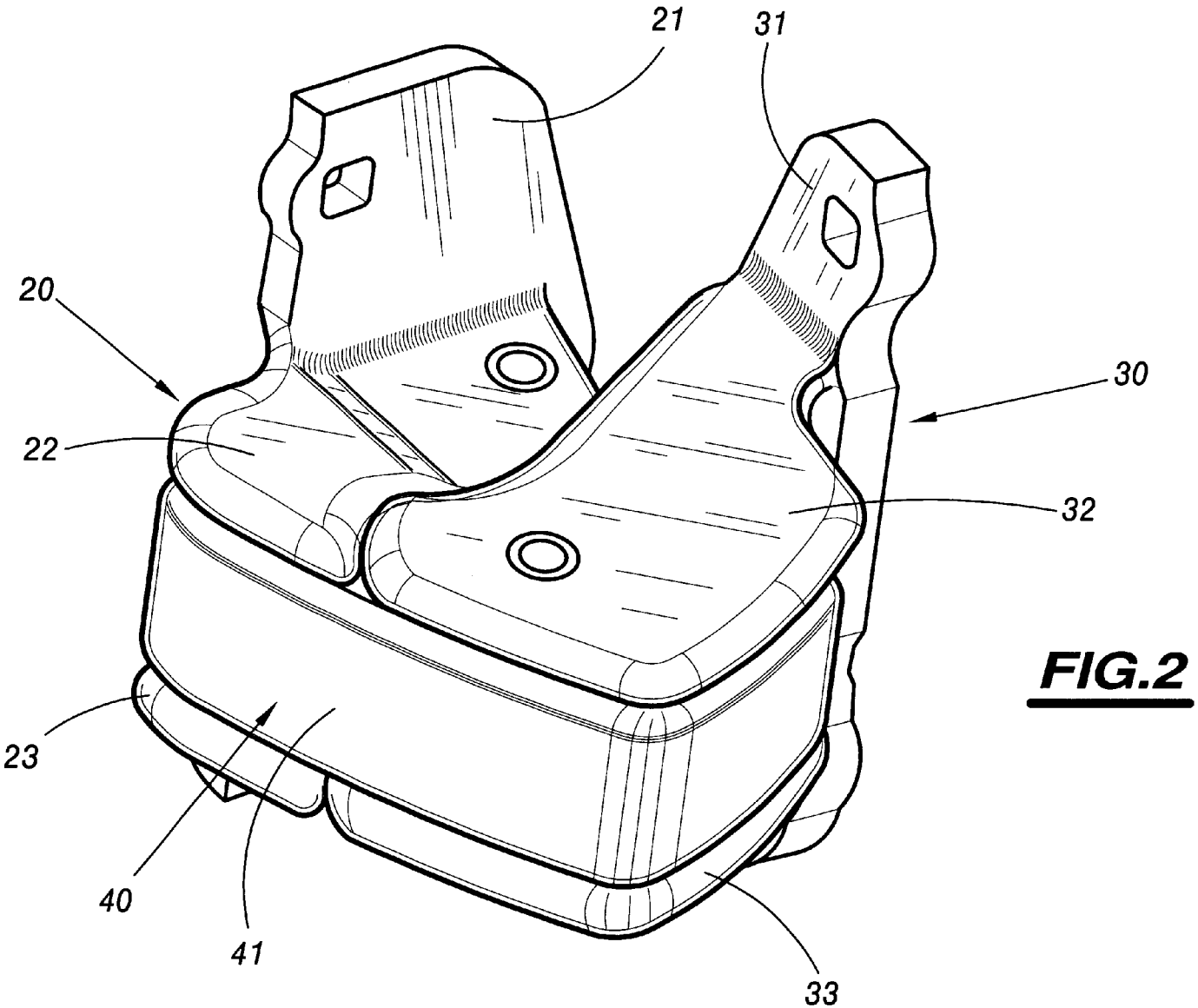
FIG. 2 is a schematic perspective view of the hinge when the door is in the closed position.
Figure 3:
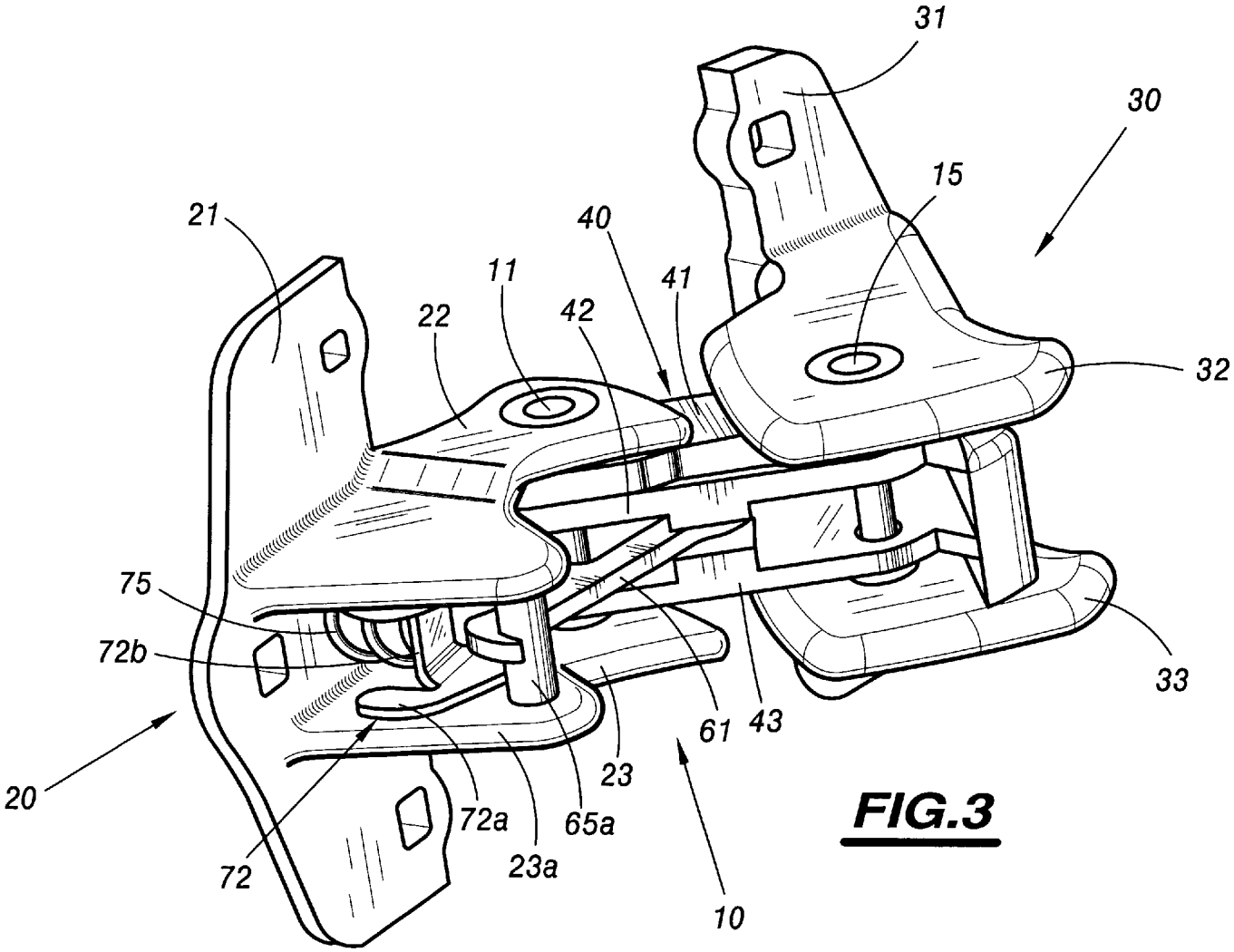
FIG. 3 is a schematic perspective view of the hinge when the door is in the open position.

As depicted in FIGS. 2 and 3, the intermediate knuckle 40 is mounted between the cheeks 22 and 23 of the fixed knuckle 20 and the cheeks 32 and 33 of the moving knuckle 30.

The fixed knuckle 20 is in the form of a clevis block comprising, on the one hand, a plate 21 intended to be fixed to the body 1 of the vehicle by means, for example, of screw-fastening elements, not depicted, and, on the other hand, two parallel cheeks 22 and 23 respectively, extending at right angles to the said plate 21.

Likewise, the moving knuckle 30 is in the form of a clevis block comprising, on the one hand, a plate 31 intended to be fixed to the rear door 2 using, for example, screw-fastening elements, not depicted, and, on the other hand, two parallel cheeks 32 and 33 respectively, extending at right angles to the said plate 31.

As depicted in FIGS. 2 and 3, the intermediate knuckle 40 is mounted between the cheeks 22 and 23 of the fixed knuckle 21 and the cheeks 32 and 33 of the moving knuckle 31.

Figure 5:
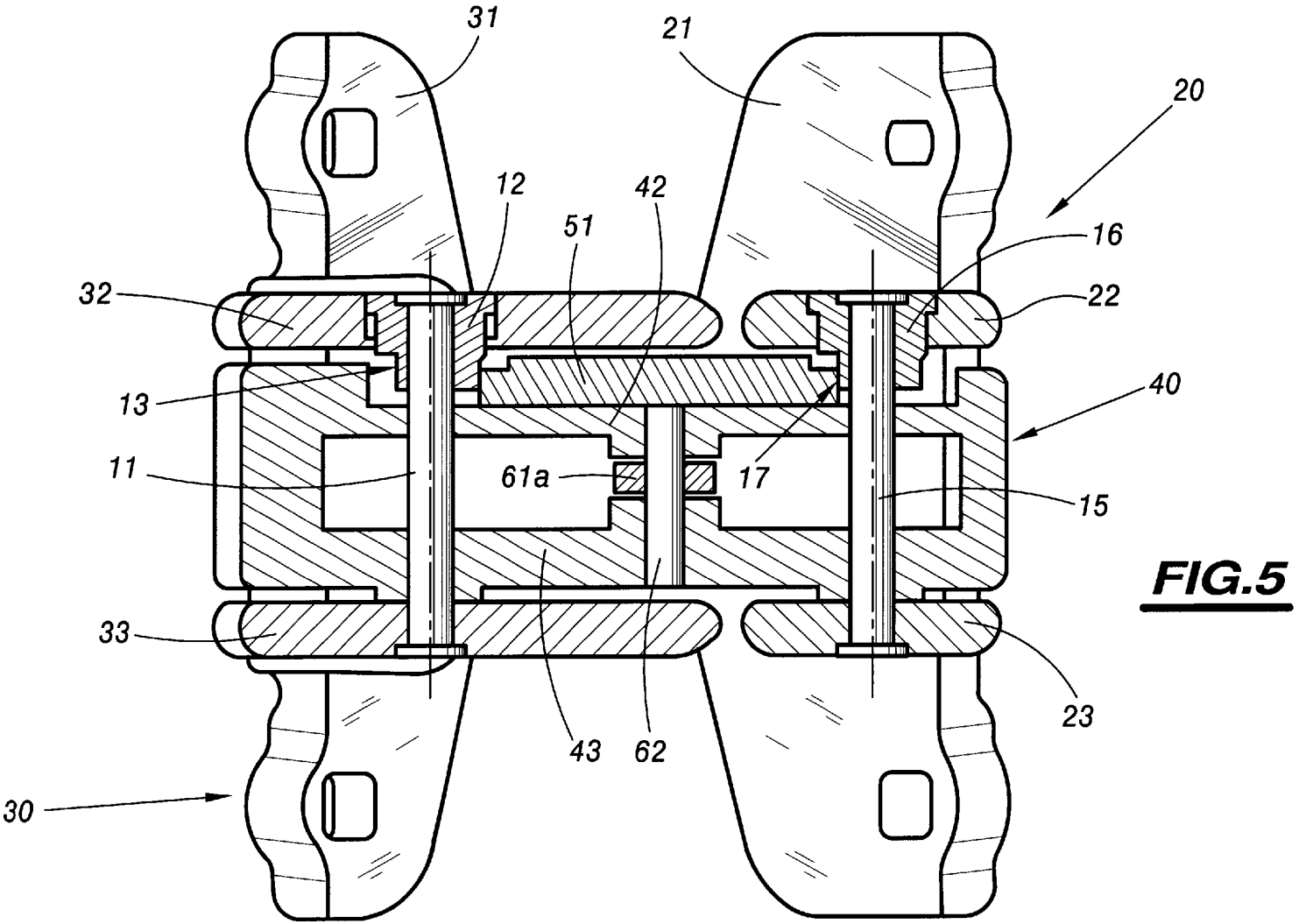
FIG. 5 is a view in section on 5—5 of FIG. 4, FIGS. 6, 7 and 8 are views in cross section of the hinge when the door is, respectively, open at 90°, 180° and 250°.

This intermediate knuckle 40 comprises a plate 41 comprising two parallel cheeks 42 and 43 respectively, perpendicular to the said plate 41 as depicted in FIGS. 3 and 5.

The intermediate knuckle 40 is connected, on the one hand, to the fixed knuckle 20 by a pin 11 which passes through the cheeks 22 and 23 of this fixed knuckle 20 and the cheeks 42 and 43 of the intermediate knuckle 40 and, on the other hand, to the moving knuckle 30 by a pin 15 which passes through the cheeks 32 and 33 of the moving knuckle 30 and the cheeks 42 and 43 of the said intermediate knuckle 40.

Figure 4:
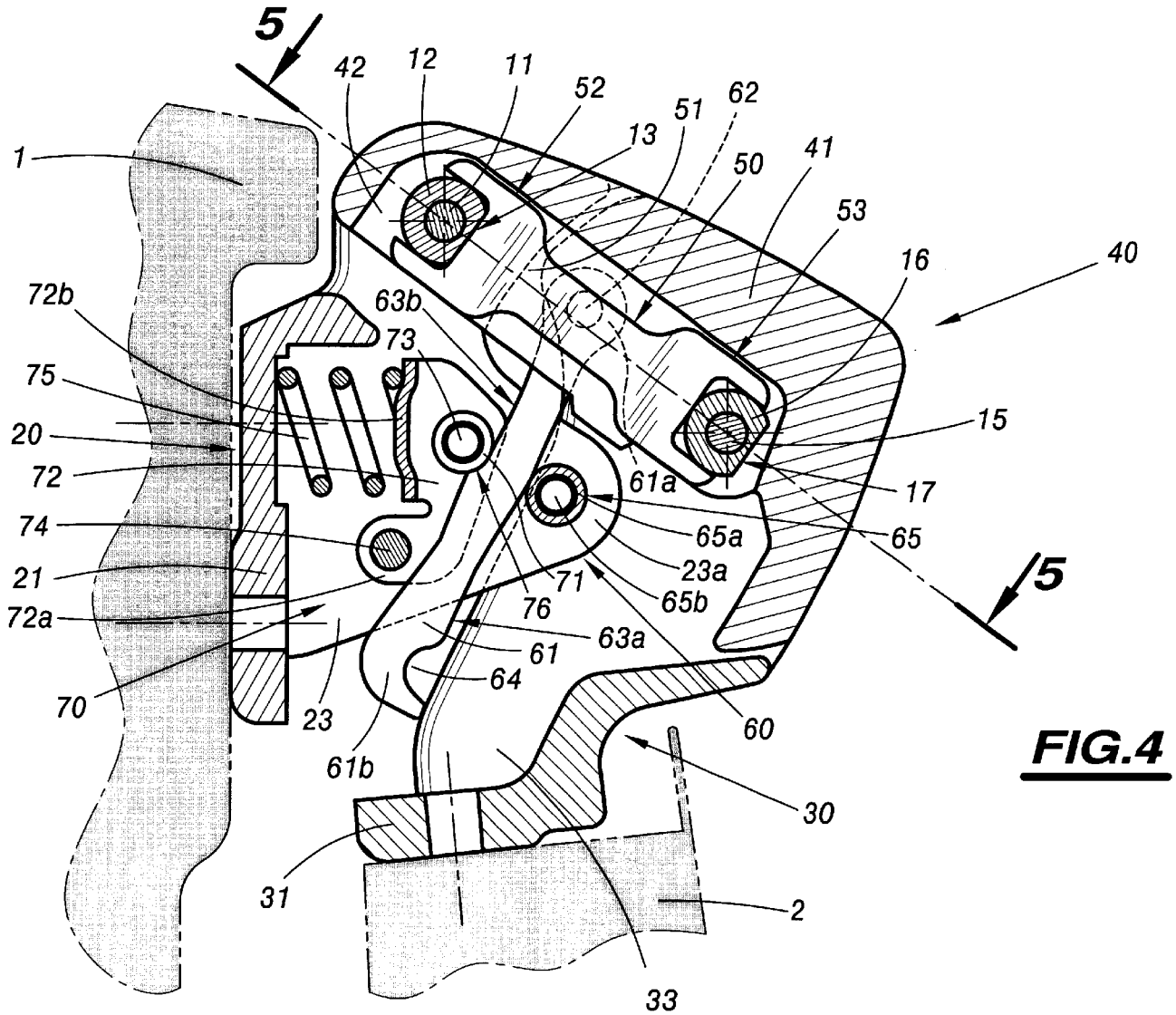
FIG. 4 is a view in cross section of the hinge when the door is the closed position.

As depicted in FIG. 4, the pin 11 fitted between the fixed knuckle 20 and the intermediate knuckle 40 is placed in a bushing 12 secured to the said fixed knuckle 20. This bushing 12 has a flat 13 on its external face.

Likewise, the pin 15 is placed in a bushing 16 which rotates as one with the mobile knuckle 30. This bushing 16 comprises, on its external face, a flat 17.

As depicted in FIGS. 3 and 4, the hinge 10 is also provided with a blocking member 50 cooperating alternately with one of the flats 13 and 17 of the said bushings 12 and 16 to successively allow the moving knuckle 30 to pivot about the pin 15, then the assembly consisting of the intermediate knuckle 40 and the mobile knuckle 30 to pivot about the pin 11 of the fixed knuckle 20 when the rear door 2 is being opened and vice versa when this rear door 2 is being closed, as will be seen later.

The blocking member 50 is formed a link rod 51 which, as depicted in FIGS. 3 and 4, presses against the upper cheek 42 of the intermediate knuckle 40 and is located between the bushings 12 and 16.

At its end facing the bushing 12 of the pin 11, the link rod 51 has a fork 52 for positioning it on the said bushing 12 and, at its end facing the bushing 16 of the pin 15, the link rod has a fork 53 for positioning it on the said bushing 16.

The link rod 51 is thus held in position, on the one hand, via the upper cheek 42 of the intermediate knuckle 40 and the cheeks 22 and 32 respectively of the fixed knuckle 20 and of the moving knuckle 30 and, on the other hand, via the respective bushings 12 and 16 of the pins 11 and 15.

In an alternative form, the link rod 51 may be arranged below the lower cheek 43 of the intermediate knuckle 40. In this case, the link rod 51 is held by the cheek 23 of the fixed knuckle 20 and the cheek 33 of the moving knuckle 30.

As depicted in FIG. 4, the width between the internal faces of the two prongs of each fork 52 and 53 is roughly equal to the outside diameter of the bushings 12 and 16 and the length of the link rod 51 between the bottoms of the two forks 52 and 53 is roughly equal to the distance separating a flat of one of the bushings from a cylindrical portion of the other of the said bushings.

Furthermore, the hinge is also fitted with means 60 for holding the rear door 2 in the wide-open position.

As depicted in particular in FIGS. 4 and 5, these means 60 are formed by a cam 61, one end 61*a* of which is mounted articulated on the intermediate knuckle 40 by means of a pin 62 located between the cheeks 42 and 43 of the said intermediate knuckle 40.

The opposite end 61*b* of this cam 61 to the one articulated to the intermediate knuckle 40 comprises a notch 64 on its lateral edge 63*a*.

As will be seen later, this notch 64 is intended to cooperate, when the rear door 2 is in the wide-open position, with a stop member 65.

This stop member 65 is formed by a fixed roller 65*a* mounted so that it is free to rotate on a pin 65*b* supported by the fixed knuckle 20 via a leg 23*a* extending the lower cheek 23*a* of the said fixed knuckle 20.

The lateral edge 63*a* of the cam 61 is kept pressed against the fixed roller 65*a* by a pressing element denoted overall by the reference 70.

The pressing element 70 is formed by a moving roller 71 mounted so that it is free to rotate on a support 72 by means of a pin 73. The support 72 has the shape of an angle bracket comprising a horizontal part 72*a* and a vertical part 72*b* and is mounted to pivot on the leg 23*a* of the fixed knuckle 20 via a pin 74 connecting the said leg 23*a* to the horizontal part 72*a* of the said support 72.

The moving roller 71 is kept pressed against the lateral edge 63*b* of the cam 61 by a spring 75 inserted between the plate 21 of the fixed knuckle 20 and the vertical part 72*b* of the support 72.

Finally, the lateral edge 63*b* of the cam 61 in contact with the moving roller 71 comprises a catch 76 allowing the intermediate knuckle 40 to be held while the moving knuckle 30 is pivoting about its pin 15.

The location of this catch 76 on the cam 61 is determined so that it corresponds to the folded-back position of the intermediate knuckle 40.

When the rear door 2 is in the closed position as depicted in FIG. 4, the flat 13 of the bushing 12 of the fixed knuckle 20 is in contact with the bottom of the fork 52 of the link rod 51 and the flat 17 of the bushing 16 of the moving knuckle 30 is on the outside of the fork 53 of the said link rod 51 and lies parallel to the flat 13 of the bushing 12 of the said fixed knuckle 20.

In this position, the bushing 12 and the intermediate knuckle 20 are blocked by the fork 52 of the link rod 51 which presses against the flat 13 of the said bushing 12 and also by the cam 61.

Specifically, the moving roller 71 is held in the catch 76 by the spring 75 which exerts pressure on the support 72.

As a result of this, the cam 61 is trapped between the fixed roller 65*a* and the moving roller 71.

Figure 6:
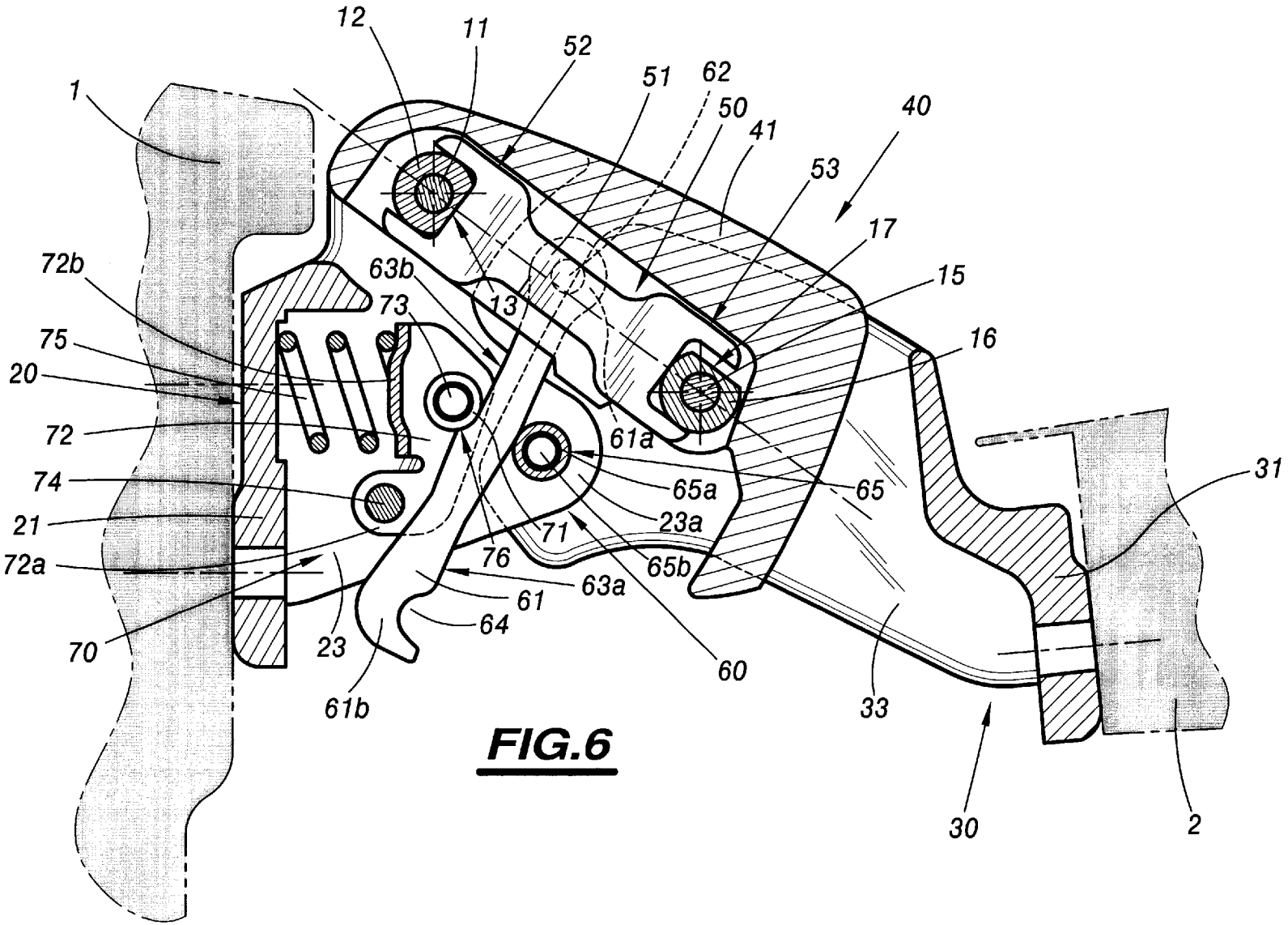

While the rear door 2 is being opened, the moving knuckle 30 pivots about the pin 15 taking with it the bushing 16 which rotates inside the fork 53 of the link rod 51 as depicted in FIG. 6.

Figure 7:
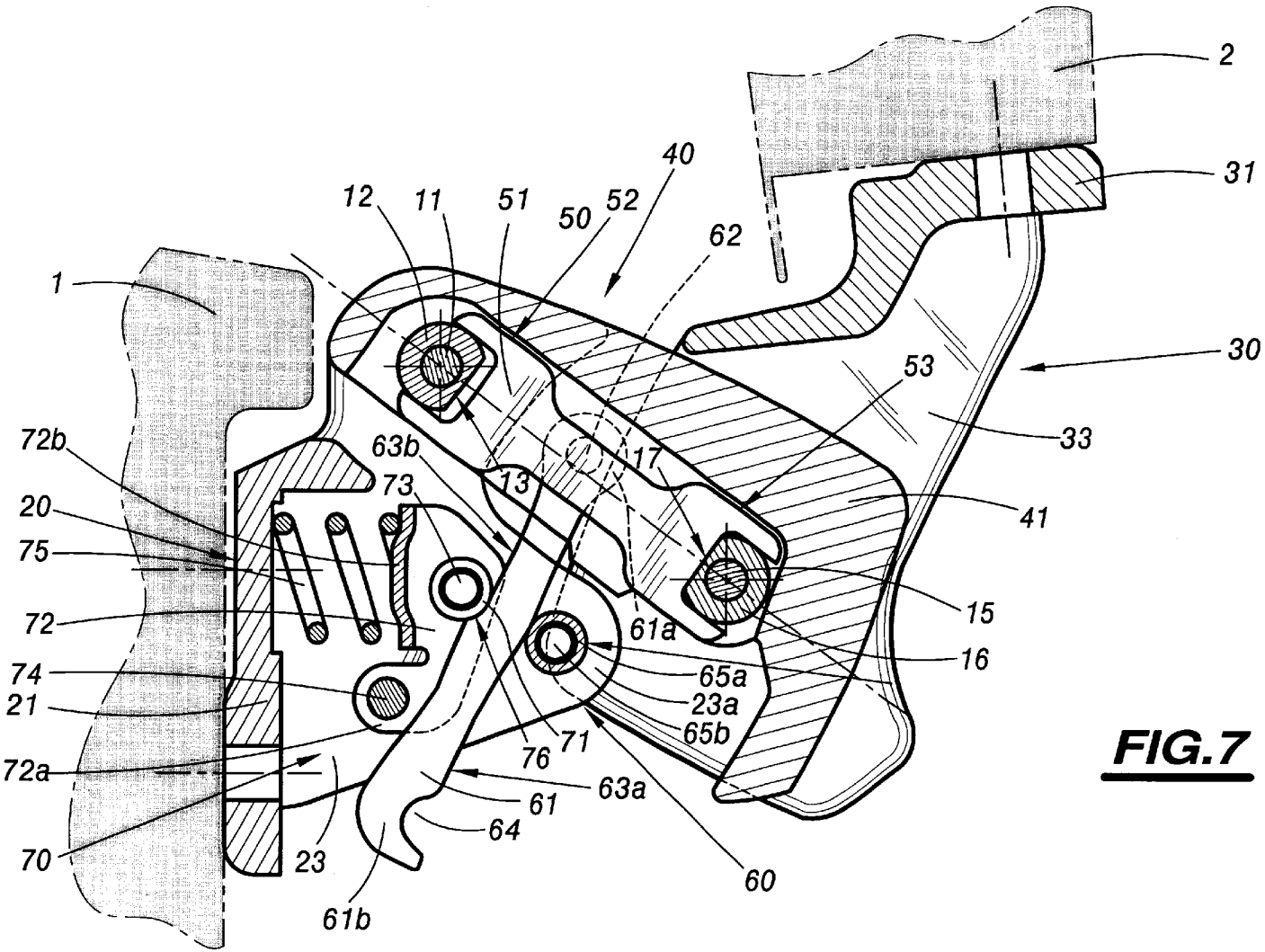

The rear door 2 and the moving knuckle 30 pivot between a first position in which this rear door 2 is closed and a second position in which this rear door is open by an angle of about 180°, as depicted in FIG. 7.

In this 180°—open position, the flat 17 of the bushing 16 secured to the moving knuckle 30 comes into contact with the bottom of the fork 53 of the link rod 51.

The two flats 13 and 17 therefore face in opposite directions and the distance separating these two flats is greater than the distance separating the bottoms of the two forks 52 and 53 of this link rod 51 so that a clearance is thus created between these two flats 13 and 17 and the two bottoms of the forks 52 and 53 of this link rod 51.

The moving roller 71 is still kept in the catch 76 of the cam 61.

Figure 8:
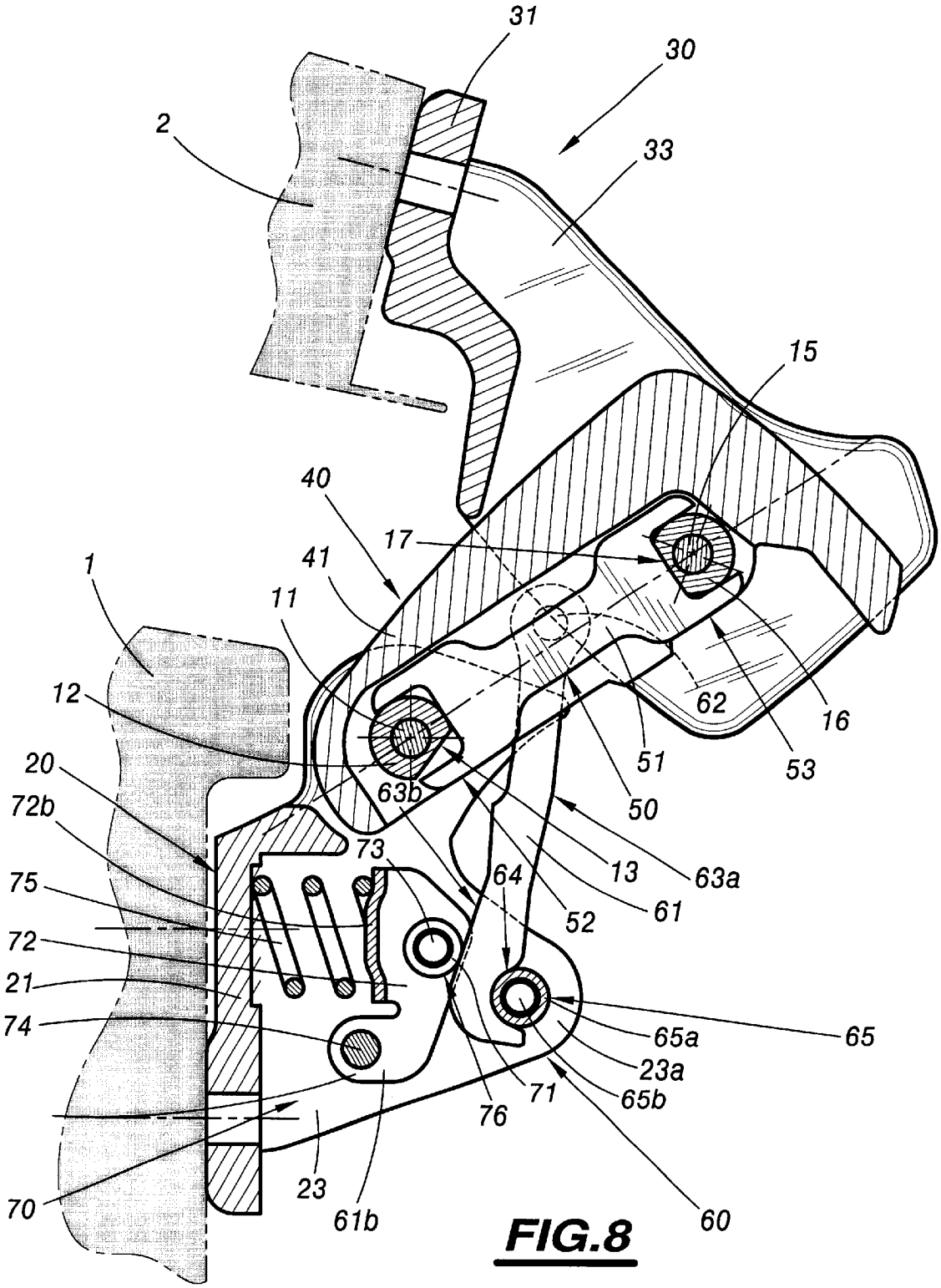

The moving knuckle 20 is now in abutment against the intermediate knuckle 40 so that as the rear door 2 pivots from this 180°-open position to the wide-open position against the side of the body of the motor vehicle as depicted in FIG. 8, the assembly consisting of this moving knuckle 30 and this fixed knuckle 40 pivots about the pin 11 because of the clearance created between the flats 13 and 17 of the bushings 12 and 16 and the bottoms of the forks 52 and 53 of the link rod 51.

During the pivoting of the rear door 2 between the 180°-open position and the wide-open position as depicted in FIG. 8, the cam 61 pivots about the pin 62 and slides between the fixed roller 65*a* and the mobile roller 71 until such time as this fixed roller 65*a* becomes lodged in the notch 64 of the cam 61, which corresponds to the wide-open position of the rear door 2.

This cam 61 is held in this position by the thrust exerted by the spring 75 on the support 72 and the moving roller 71.

While the rear door 2 is being closed, the user pulls on the rear door 2 so as, via the moving knuckle 30 and the intermediate knuckle 40, to exert pressure on the cam 61.

While this pressure is being applied, the support 72 pivots about the pin 74 against the force exerted by the spring 75 and the notch 64 of the cam 61 disengages from the fixed roller 65*a* and this cam 61 slides between this fixed roller 65*a* and the moving roller 71.

As soon as the intermediate knuckle 40 has reverted to its initial position, the moving roller 71 positions itself in the catch 76 and the user closes the rear door 2.

The hinge according to the invention has the advantage of having a built-in door stop, thus limiting the number of parts and avoiding additional assembly operations by comparison with the hinges hitherto used which are associated with independent door-stop systems.

What is claimed is:

1. A motor vehicle rear door hinge comprising:

a fixed knuckle (20) mounted on a body (1) of the vehicle;

a moving knuckle (30) mounted on a rear door (2) of the vehicle, the door being movable between a closed position and an open position resting against a side of the body (1);

an intermediate knuckle (40) connected to each of said fixed and moving knuckles (20; 30) by respective hinge pins (11; 15);

means (60) for holding the rear door (2) in the open position, said means including a cam (61), one end (61*a*) of which is mounted articulated on said intermediate knuckle (40) and the other end (61*b*) of which has a notch (64) on a first lateral edge of said cam cooperating, when the rear door (2) is in the open position, with a stop member (65) supported by said fixed knuckle (20);

said first lateral edge (63*a*) of said cam (61) being held against said stop member (65) by a pressing element (70) cooperating with a second lateral edge (63*b*) of said cam (61) opposite said first lateral edge, said pressing element (70) comprising a moving roller (71) rotatably mounted on a support (72) borne by said fixed knuckle, said support (72) being pivotally mounted a leg (23*a*) of said fixed knuckle (20), and said moving roller (71) being held against said second lateral edge (63*b*) by a spring (75) acting on said support (72).

2. The hinge according to claim 1, wherein said stop member (65) comprises a fixed roller (65*a*) rotatably mounted on a pin (65*b*) supported by said fixed knuckle (20).

3. The hinge according to claim 1, wherein said second lateral edge (63*b*) comprises a catch (76) for holding said intermediate knuckle (40) while said moving knuckle (30) is pivoting about the respective one of said hinge pins (15).

* * * * *